US006206766B1

(12) United States Patent
Schuller

(10) Patent No.: US 6,206,766 B1
(45) Date of Patent: Mar. 27, 2001

(54) GRINDING WHEEL

(75) Inventor: Richard Schuller, Stadtbergen (DE)

(73) Assignee: August Heinr. Schmidt GmbH & Co. KG Maschinenfabrik, Stuttgart (DE)

( * ) Notice: Subject to any disclaimer, the term of this patent is extended or adjusted under 35 U.S.C. 154(b) by 0 days.

(21) Appl. No.: 09/341,219

(22) PCT Filed: Feb. 17, 1998

(86) PCT No.: PCT/DE98/00484

§ 371 Date: Jul. 7, 1999

§ 102(e) Date: Jul. 7, 1999

(87) PCT Pub. No.: WO98/51447

PCT Pub. Date: Nov. 19, 1998

(30) Foreign Application Priority Data

May 13, 1997 (DE) ..... 197 19 971
Sep. 1, 1997 (DE) ..... 297 15 683 U

(51) Int. Cl.[7] ..... B24B 7/00

(52) U.S. Cl. ..... 451/259; 451/359; 451/290; 451/548; 451/342

(58) Field of Search ..... 451/259, 451, 451/453, 358, 359, 546, 548, 290, 268, 269, 510, 340, 342; 83/876

(56) References Cited

U.S. PATENT DOCUMENTS 2,072,051 * 2/1937 Vander Pyl ..... 51/280
3,566,547 * 3/1971 Lonaberger et al. ..... 51/168
3,571,980 * 3/1971 Fisher ..... 51/206
3,728,827 * 4/1973 Koppenwallner ..... 51/168
3,800,483 * 4/1974 Sherman ..... 51/376
4,326,361 * 4/1982 McGill ..... 51/168
4,428,120 * 1/1984 Kobayashi et al. ..... 30/390
4,455,788 * 6/1984 Freerks ..... 51/334
4,729,193 * 3/1988 Gant et al. ..... 51/168
5,259,145 * 11/1993 Fushiya et al. ..... 51/168
5,516,326 * 5/1996 Virnich ..... 451/340
5,895,317 * 4/1999 Timm ..... 451/548

* cited by examiner

*Primary Examiner*—Lee Young
*Assistant Examiner*—Minh Trinh
(74) *Attorney, Agent, or Firm*—Barnes & Thornburg

(57) ABSTRACT

The invention relates to a grinding wheel for machining metal circular-saw blades at relatively high rotational speeds, which have machining areas which contain in particular hard materials, such as for example diamond or cubic boron nitride. The grinding wheels according to the invention are intended in particular to improve the centring at relatively high rotational speeds, and consequently to prevent true running problems as far as possible. The base body of the grinding wheel is of contoured design, at least on one side, in the radially outer area of a tool-mounting bore, and at least one centring element can be designed to engage in a formfitting manner in the correspondingly designed contours, so that the grinding wheel and a centring element on a tool spindle of a grinding machine are held together in a force-fitting manner.

13 Claims, 3 Drawing Sheets

GRINDING WHEEL

CROSS-REFERENCES TO RELATED APPLICATIONS

This application is a U.S. national application of international application Serial No. PCT/DE98/00484 filed Feb. 17, 1998, which claims priority to German Serial Nos. 197 19 971.2 and 297 15 683.7 filed May 13, 1997 and Sep. 1, 1997, respectively.

The invention relates to a grinding wheel for machining metal-circular saw blades at relatively high rotational speeds, such grinding wheels having machining areas which contain hard materials, such as for example diamond or cubic boron nitride, which can be used to achieve high material-removal rates.

DE 296 08 590 has disclosed grinding wheels for machining metal circular-saw blades, in which the centering and alignment on a drive shaft of a grinding machine is intended to be improved by designing the diameter of the tool-mounting bore which is formed in the grinding wheel to widen on one side.

However, grinding wheels whose machining areas contain cubic boron nitride or diamond abrasive particles allow very high material-removal rates to be achieved if the cutting rate and therefore the rotational speed of the grinding wheel are set to be correspondingly higher. These increased rotational speeds lead to the centering, which the design of the tool-mounting bore is supposed to improve, deteriorating as a result of the increasing centrifugal forces.

Furthermore, this leads to true running problems arising, and in particular to the vibrations, which are transmitted into the machining area by the true running problems, causing high levels of wear in the machining area as a result of increased abrasion of the hard materials, so that the grinding wheels have to be dressed or replaced more frequently.

Therefore, the object of the invention is to improve grinding wheels in such a manner that the centering can be improved, in particular at relatively high rotational speeds, and consequently true running problems can be avoided.

According to the invention, this object is achieved by means of the features of claim 1. Advantageous configurations and refinements of the invention are given by using the features mentioned in the subordinate claims.

The grinding wheels according to the invention differ from the grinding wheels which have customarily been used hitherto in particular in that a contour, in which at least one centering element can engage in a form-fitting manner, is provided in the base body of the grinding wheel, at least on one side, in the radially outer region of the tool-mounting bore, which may be of conventional design or may be designed as disclosed by DE 296 08 590. During grinding, the grinding wheel and at least one centering element are held in a force-fitting manner on the tool spindle of the grinding machine. For this purpose, a conventional screw connection, for example, may be used, although it is also possible to employ hydraulically or pneumatically actuable piston-cylinder units or a spring force, these options being suitable in particular for automatic operation.

It is particularly advantageous for the contour to be formed on both sides of the base body of the grinding wheel, and to maintain symmetrical conditions.

The only factor which needs to be taken into account during contouring is that a bearing surface for the centering element(s) is to be present on at least one side, on which bearing surface a surface, which is directed towards the axis of rotation of the grinding wheel, of the centering element(s) is supported, and the centering action can be improved at relatively high rotational speeds as a result of the centrifugal forces.

There are a number of possible designs for the contour(s). A circular groove may be formed on one or both sides of the base body of the grinding wheel, in which groove corresponding webs on the centering element(s) engage in a form-fitting manner and virtually without play when the grinding wheel is attached to the drive spindle of the grinding machine. It is advantageous if those areas of the centering element(s) which engage in the grooves and are of web-like design are convex, at least on their internal diameter, so that they do not bear against the corresponding surface of the groove over the entire area, thus facilitating insertion.

Another possible design of the contour(s) consists in forming a flange-like widening, which projects beyond the normal thickness of the base body of the grinding wheel and on which there is at least one radially outer bearing surface for the centering element (s), on which bearing surface the centering element(s) can be supported. Advantageously, the bearing surface(s) is/are inclined with respect to the axis of rotation.

The contour may also, however, be a web which runs in a circle and may, if appropriate, be symmetrically divided into individual segments by means of apertures. In this case, the centering element(s) is/are in each case supported against the radially outer surface of the web.

The possible examples for the design of the contours may be improved by forming bearing surfaces which are bevelled on at least one side and on which the corresponding bearing surfaces on the centering element(s) are supported. Bevelled surfaces have the advantage, on the one hand, of providing larger bearing surfaces and, on the other hand, of facilitating the introduction or fitting together of the centering elements when the grinding wheel is being attached to the grinding machine, and if necessary alignment errors can be compensated for during introduction, thus reducing the wear on the centering elements and the base body of the grinding wheel.

The possible designs of the contours which have been described thus far can be achieved relatively easily by machining operations for the case of the grooves and the flange-like design, but it is also possible to provide the base body of the grinding wheel with the desired shape by means of known casting processes.

Furthermore, it is also possible to achieve the improvement in the centering for the grinding wheels in question by designing the contours in the form of apertures or recesses through or in the base body of the grinding wheel, or by additionally providing such recesses or apertures. In this case, at least two apertures or recesses which are arranged symmetrically opposite one another in the radial direction on one axis are required, in order to compensate for the centrifugal forces which arise and to avoid undesirable imbalances.

The recesses or apertures may advantageously be improved if they are designed to widen conically outwards, in order, as is already the case for the bevelled design of certain surface areas of the grooves, flanges or webs, to improve in particular the insertion of the centering elements.

It is advantageous for one of the corresponding centering elements to be provided in a stationary position on the flange of the drive spindle of the grinding machine, while on the other side of the grinding wheel an additional centering element, which is preferably of corresponding design, is held in a force-fitting manner in the contour and the tool-mounting bore of the grinding wheel. The second centering element may in this case be a separate component which can be held in a force-fitting manner towards the flange of the drive spindle of the grinding machine.

If the grinding wheel is attached to the drive spindle by means of a screw connection, it is advantageous to join the screw and the centering element together, thus facilitating handling. It is particularly advantageous if the connection is designed in such a way that the screw can rotate independently of the movement of the centering element, i.e. in such a manner that the centering element is prevented from rotating with the screw.

If, on the other hand, a piston-cylinder arrangement is selected, the centering element may be part of the piston or of the cylinder, depending on which of the two elements is used to attach the grinding wheel to the drive spindle.

In addition to the improved centering action at high rotational speeds, which is improved by the improved support for the grinding wheel in the radial direction, and is further promoted by the centrifugal force effect, noting that the centrifugal force increases as the square of the speed, it is also possible to transmit a higher torque as a result of increasing the sizes of the surfaces which are frictionally connected.

The invention will be explained in more detail below with reference to exemplary embodiments. In the drawings:

FIG. 1 shows a number of possible contours which can be used according to the invention.

Figure 1:
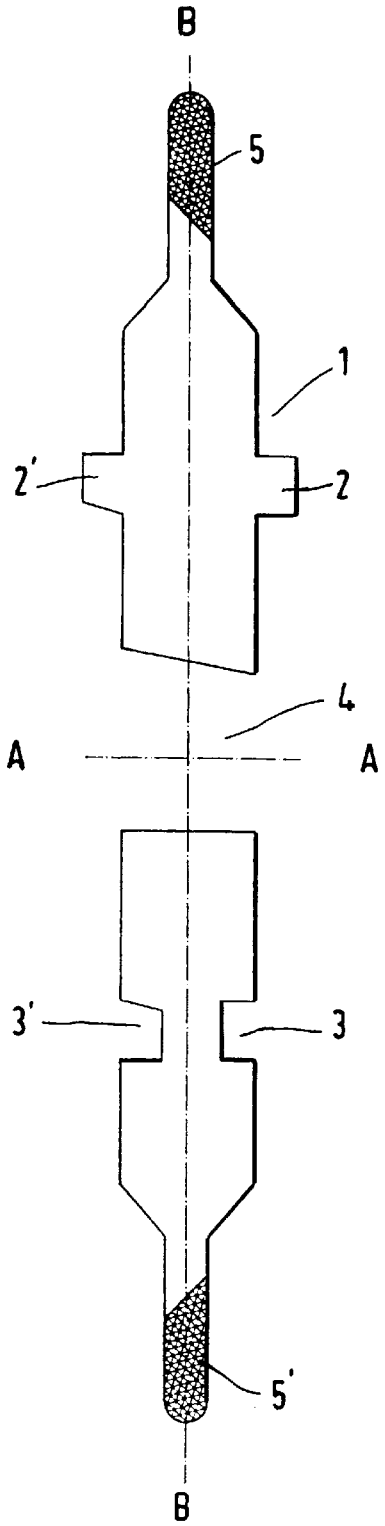
FIG. 1 shows a number of possible designs for a grinding wheel according to the invention.

Contours in the form of webs 2 and 2' are shown on the grinding wheel 1 above the axis of rotation A, the web 2 to the right of the center axis B of the grinding wheel 1 being virtually symmetrical, with a rectangular or square cross-section; this design can be produced at lower cost, at least if the corresponding base body of a grinding wheel 1 is machined, than the web 2' which is shown to the left of the center axis B and which has at least one bevelled or convex bearing surface for a centering element. In the example shown, the radially inner bearing surface of the web 2' is bevelled, although it is also possible for the radially outer bearing surface of this web, or even both bearing surfaces, to be of bevelled or convex design.

Contours in the form of grooves 3 and 3' are shown below the axis of rotation A, a groove 3 of rectangular or square cross-section again being shown to the right of the center axis B of the grinding wheel 1, while the groove 3' shown on the other side of the center axis B is to have at least one bevelled bearing surface for a centering element (not shown).

The design of the contouring in the radially outer area of the tool-mounting bore 4, which beneath the axis of rotation A is in simple form and above the axis of rotation A is in bevelled form, as is known from DE 296 08 590, should, however, always be symmetrical with regard to the axes A and B, i.e. contours in the form of webs 2 or 2' or grooves 3 or 3' should be provided on a grinding wheel 1, in order to facilitate balancing of the grinding wheel 1.

In a similar fashion to the grooves 3 or 3', it is also possible to form recesses or apertures in the base body of the grinding wheel, but these recesses or apertures should be arranged in mutually opposite pairs, and correspondingly projecting areas of the centering elements could engage in these recesses or apertures.

FIG. 1 furthermore shows various possible designs of the machining areas 5 and 3' of a grinding wheel according to the invention, which contain the hard materials cubic boron nitride or diamond.

Figure 2:
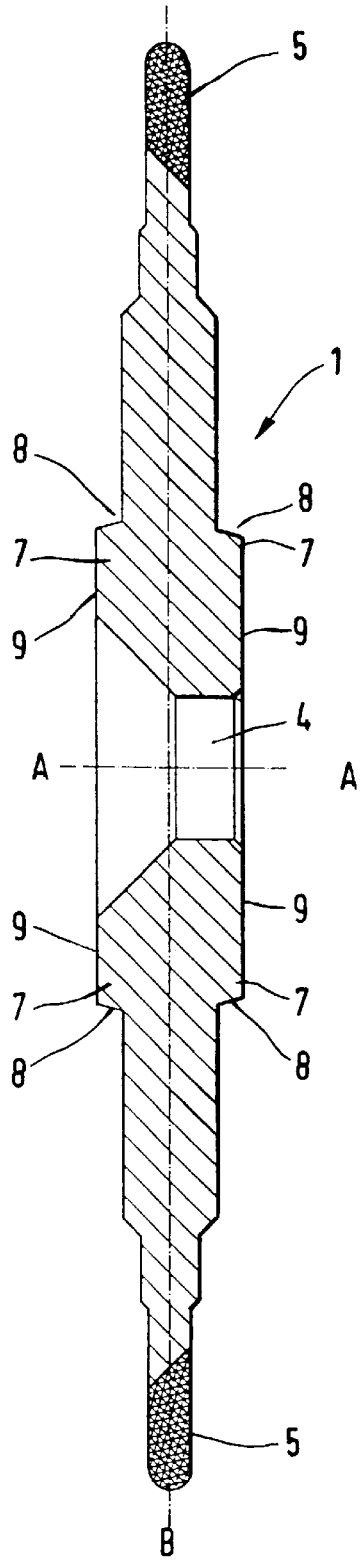
FIG. 2 shows an example of a grinding wheel according to the invention on its own.

FIG. 2 shows a further example of the grinding wheel 1 according to the invention. In this case, the contour 7 is a flange-like widening in the radially outer area with respect to the tool-mounting bore 4, on the radially outer edge of which widening there are bearing surfaces 8 for one or two centering elements 6 (not shown). The bearing surfaces 8 are inclined at an angle of 15° with respect to the axis of rotation A.

Part of the internal diameter of the tool-mounting bore 4 is designed to widen conically, the cone in this case forming an angle of 90°. The cone is advantageously dimensioned in such a way that it extends at least as far as the center axis B of the grinding-wheel base body or even beyond, while the remaining part of the tool-mounting bore 4 is of cylindrical design.

The tool-mounting bore 4 may, however, also be designed in such a way (not shown) that the conical part is surrounded by two cylindrical parts, in which case the cylindrical part which adjoins the larger diameter of the conical part has a larger internal diameter than the other, opposite cylindrical part. The centering element 6 may then be of corresponding design and may bear against the cone and the adjoining end face of the cylindrical part of the tool-mounting bore 4.

Moreover, planar support surfaces 9 are present in the radially outer area with respect to the tool-mounting bore 4, against which support surfaces the centering element(s) (6) or a clamping element bear(s) in the fixed position of the grinding wheel 1.

The cone may, however, also be designed (in a form which is not illustrated) on both sides of the grinding wheel 1, in which case two correspondingly designed centering elements may be used on either side.

Figure 3:
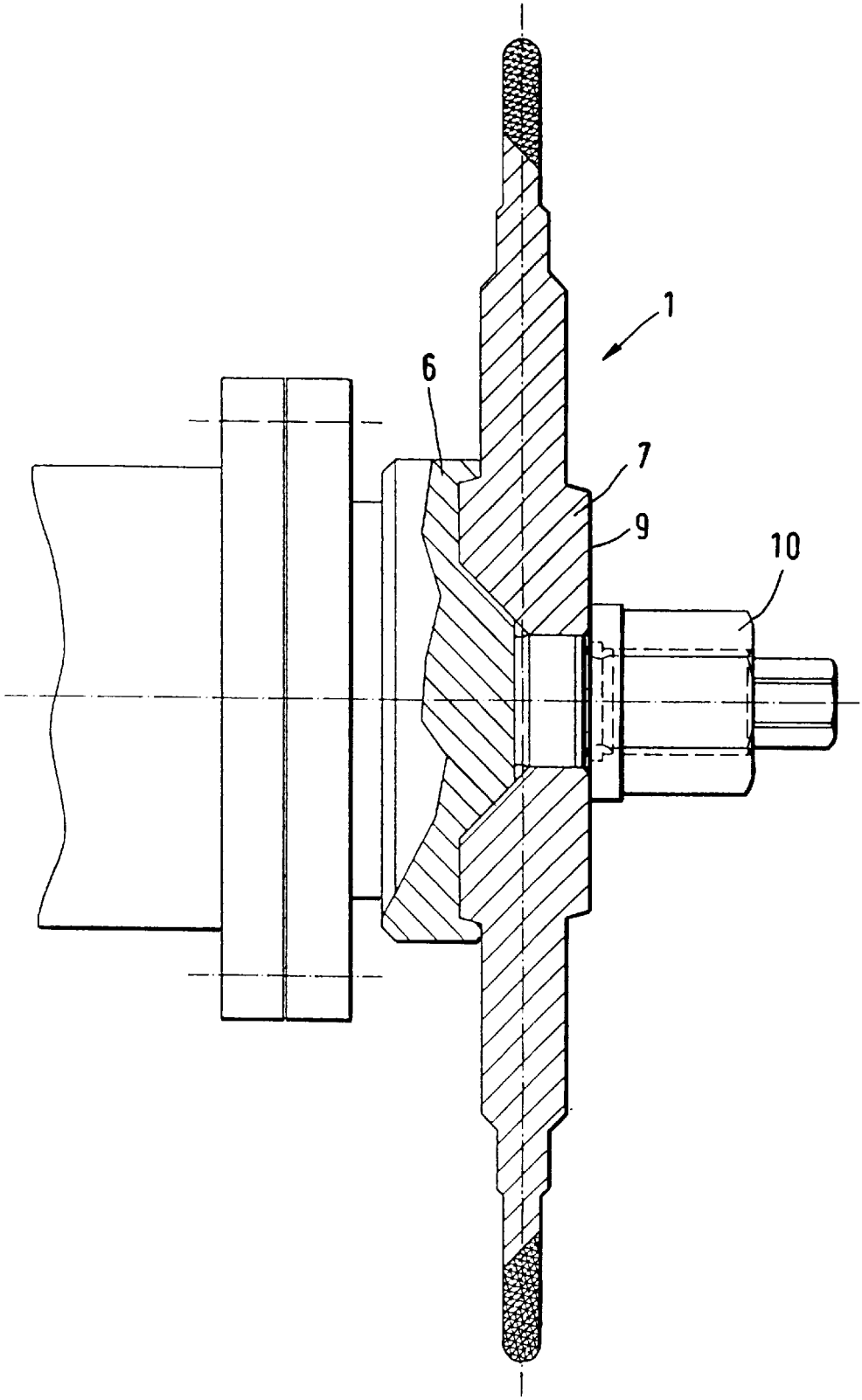
FIG. 3 shows the example illustrated in FIG. 2, in a centering, secured position.

FIG. 3 shows the example in accordance with FIG. 2 in the position where it has been fixed on a drive spindle of a grinding machine for metal circular-saw blades.

A centering element 6 is connected to the drive shaft of the grinding machine. The grinding wheel 1 is held in a force-fitting manner against the centering element 6 by means of a clamping screw 10, and during the attachment the grinding wheel 1 is simultaneously centered and fixed. FIG. 3 clearly shows how the conical internal diameter of the tool-mounting bore, the support surface 9 and the bearing surface 8 of the flange-like contour 7 of the grinding wheel 1 bear against the centering element 6 and thus the grinding wheel 1 is held aligned. The large surface areas provide reliable guidance even at relatively high rotational speeds. Moreover, relatively high frictional forces are available and make it possible to reduce the clamping force which has to be applied by means of the clamping screw 10 or some other clamping element, so that the service life of at least the centering elements 6 is prolonged.

The centrifugal forces which act at high rotational speeds are absorbed and largely compensated for at the bearing surface 8 of the contour 7, with the corresponding design of the centering element 6, at the outer edge of the latter. For this purpose, the centering element 6 is recessed between its outer edge and the conically widening external diameter, i.e. in the area of the support surface 9 which is present on this side of the grinding wheel 9 and is smaller than the support surface 9 which is present on the other side. As a result, the inner outer edge of the centering element 6 bears against the bearing surface 8, and the recessed area bears against the support surface 9.

What is claimed is:

1. A grinding wheel for centrally mounting on a tool for machining metal circular-saw blades, the grinding wheel comprising a radially outer area having a machining area which is provided with an abrasive coating, a center mount area including a tool-mounting bore with an internal diameter which widens on at least one side of the grinding wheel (1), further including a base body having on at least one side a contour in the radially outer region of the center mount area (4), for the form-fitting engagement of a centering element (6) having an external contour, the external contour being matched to the internal contour of the center mount area (4), wherein the contour (7) is a flange-like widening greater in thickness than the grinding-wheel base body, the widening having at least one radially outer bearing surface (8) for engaging the centering element (6), and further including planar support surfaces (9) positioned perpendicular to the axis of rotation (A) between the at least one bearing surface (8) and the center mount area (4).

2. The grinding wheel according to claim 1 wherein the contour is formed on both sides of the grinding wheel (1).

3. The grinding wheel according to claim 1 wherein the contour (7) is a flange-like widening beyond the thickness of the grinding-wheel base body, which widening has at least one radially outer bearing surface (8) for a centering element (6).

4. The grinding wheel according to claim 1 wherein the at least one bearing surface (8) is bevelled with respect to the axis of rotation (A) of the grinding wheel (1).

5. The grinding wheel according to claim 3 further including planar support surfaces (9) which are perpendicular to the axis of rotation (A), the planar support surfaces being provided between the bearing surface(s) (8) and tool-mounting bore (4).

6. The grinding wheel according to claim 1 wherein the contour is a circular web.

7. The grinding wheel according to claim 1 further including at least two apertures or recesses which lie symmetrically opposite one another in the radial direction on a single axis, the at least two apertures being formed in the base body of the grinding wheel (1).

8. The grinding wheel according to claim 7 wherein the recesses or apertures widen conically outwards.

9. The grinding wheel according to claim 1 wherein the tool-mounting bore (4) includes a tapering part which tapers from one side of the grinding wheel (1), and the remaining part of the tool-mounting bore (4) is cylindrical.

10. The grinding wheel according to claim 9 wherein the tapering part of the tool-mounting bore (4) extends at least as far as a center of the grinding-wheel base body.

11. The grinding wheel according to claim 9 wherein the tapering part of the tool-mounting bore (4) is surrounded on both sides by cylindrical parts having different internal diameters.

12. The grinding wheel according to claim 9 wherein the tapering parts of the tool-mounting bore (4) and of the centering element (6) are formed at an angle of 90°.

13. A grinding wheel for machining metal circular-saw blades, which at least in its radially outer area has a machining area which is provided with an abrasive coating and, in the area of the tool-mounting bore, is designed with an internal diameter which widens on at least one side wherein the base body of the grinding wheel (1), at least on one side, has an additional contour (2, 2', 3, 3', 7) in the radially outer region of the tool-mounting bore (4), for the form-fitting engagement of a centering element (6), the external contour of which is matched to the internal contour of the tool-mounting bore (4), the contour (7) is a flange-like widening beyond the thickness of the grinding-wheel base body, which widening has at least one radially outer bearing surface (8) for a centering element (6), the at least one bearing surface (8) is bevelled with respect to the axis of rotation (A) of the grinding wheel (1), the bearing surfaces (8) being inclined at an angle of 15° with respect to the axis of rotation (A) of the grinding wheel (1).

* * * * *